US009799431B2

(12) United States Patent
Liu et al.

(10) Patent No.: US 9,799,431 B2
(45) Date of Patent: Oct. 24, 2017

(54) ARTIFICIAL ELECTROMAGNETIC MATERIAL

(75) Inventors: Ruopeng Liu, Shenzhen (CN); Lin Luan, Shenzhen (CN); Chaofeng Kou, Shenzhen (CN); Fanglong He, Shenzhen (CN); Zhiya Zhao, Shenzhen (CN); Jincai Ye, Shenzhen (CN)

(73) Assignee: KUANG-CHI INNOVATIVE TECHNOLOGY LTD., Shenzhen, Guangdong (CN)

( * ) Notice: Subject to any disclaimer, the term of this patent is extended or adjusted under 35 U.S.C. 154(b) by 230 days.

(21) Appl. No.: 14/111,498

(22) PCT Filed: Oct. 27, 2011

(86) PCT No.: PCT/CN2011/081385
§ 371 (c)(1),
(2), (4) Date: Oct. 11, 2013

(87) PCT Pub. No.: WO2012/139367
PCT Pub. Date: Oct. 18, 2012

(65) Prior Publication Data

US 2014/0043124 A1 Feb. 13, 2014

(30) Foreign Application Priority Data

Apr. 12, 2011 (CN) ..... 2011 1 0091136
Jun. 17, 2011 (CN) ..... 2011 1 0163799
Jun. 29, 2011 (CN) ..... 2011 1 0179773

(51) Int. Cl.
*H01F 1/00* (2006.01)
*H01Q 15/08* (2006.01)
(Continued)

(52) U.S. Cl.
CPC ..... *H01F 1/00* (2013.01); *H01Q 15/0086* (2013.01); *H01Q 15/08* (2013.01); *H01Q 15/10* (2013.01)

(58) Field of Classification Search
CPC ..... H01Q 15/10
See application file for complete search history.

(56) References Cited

U.S. PATENT DOCUMENTS

2010/0141358 A1* 6/2010 Akyurtlu et al. ..... 333/219.1
2010/0314040 A1* 12/2010 Tyler, II ..... G02B 1/007 156/278

FOREIGN PATENT DOCUMENTS

CN 101494310 A 7/2009
CN 101494317 A 7/2009
(Continued)

OTHER PUBLICATIONS

"Artificial Negative Permeability Based on a Fractal Jerusalem Cross," Katko, 2009, Undergraduate Honors Thesis, The Ohio State University.*

(Continued)

*Primary Examiner* — Ian Rummel
(74) *Attorney, Agent, or Firm* — Birch, Stewart, Kolasch & Birch, LLP

(57) ABSTRACT

The present invention provides an artificial electromagnetic material, comprising at least one material sheet layer; wherein each material sheet layer is provided with a first substrate and a second substrate which are oppositely arranged; and a plurality of artificial microstructures are attached on a surface, facing the second substrate, of the first substrate. The first substrate and the second substrate on both sides of the artificial microstructure are in such tight contact therewith that the number of electric field lines passing through the substrates is increased and the equiva- (Continued)

lent permittivity of the artificial electromagnetic material is effectively improved.

4 Claims, 6 Drawing Sheets

(51) Int. Cl.
*H01Q 15/10* (2006.01)
*H01Q 15/00* (2006.01)

(56) References Cited

FOREIGN PATENT DOCUMENTS

| | | | |
|---|---|---|---|
| CN | 201515017 | U | 6/2010 |
| CN | 101826657 | A | 9/2010 |
| JP | 2010-56112 | A | 3/2010 |

OTHER PUBLICATIONS

"Asymmetric chiral metamaterial circular polarizer based on four U-shaped split ring resonators," Mutlu et al., Mar. 2011, Optics Letters, vol. 36, No. 9, p. 1653-1655.*

* cited by examiner

ARTIFICIAL ELECTROMAGNETIC MATERIAL

FIELD OF THE INVENTION

The present invention relates to a material, and particularly relates to an artificial electromagnetic material.

BACKGROUND OF THE INVENTION

Permittivity is a parameter of material for electric field response, induced charges can be generated when an electric field is externally applied to the material, and the electric field is weakened. The ratio of the externally applied electric field in the original vacuum to an electric field in the final material is the permittivity, also called inductivity.

In the natural world, any material has a specific permittivity value or permittivity curve under specific conditions. The range of the conventional permittivity is from 1 to 30, and a material with the permittivity of over 30 belongs to high-permittivity materials. When the material with higher permittivity is placed in the electric field, the strength of the field can be considerably reduced inside a dielectric material. Therefore, the material with high permittivity is usually used for manufacturing capacitors.

Along with rapid development of technologies, higher requirements are imposed on application of the material. In some scenarios, a permittivity value much higher than the permittivity of the existing material in the natural world is desired. Nevertheless, existing insulators with higher permittivity still fail to satisfy such requirements. This presents great challenges for development of technologies and products. In practice, it is difficult for all materials existing in the nature are difficult to satisfy such requirements. Accordingly, artificially manufactured metamaterials are desired to achieve the technical objective.

The metamaterial, i.e., an artificial electromagnetic material, is a novel artificial synthetic material capable of responding to electromagnetism, and consists of substrates and artificial microstructures attached on the substrates. The artificial microstructures are usually in structures with certain geometric patterns which are arranged using metal wires. Therefore, the artificial microstructures are capable of responding to the electromagnetism, such that the metamaterial integrally represents electromagnetic properties different from the substrate, for example, different permittivities and permeabilities. However, the existing metamaterial is affected by structural features of the metamaterial, thereby failing to obtain a high permittivity, for example, a permittivity value of higher than 30 or even 50.

SUMMARY OF THE INVENTION

The present invention provides an artificial electromagnetic material capable of obtaining a high permittivity.

To solve the above technical problem, the present invention provides an artificial electromagnetic material, wherein the artificial electromagnetic material comprises at least one material sheet layer. Each material sheet layer is provided with a first substrate and a second substrate which are oppositely arranged; and a plurality of artificial microstructures are attached on a surface, facing the second substrate, of the first substrate.

The space between the first substrate and the second substrate is equal to the thickness of the artificial microstructures.

The space between the first substrate and the second substrate is smaller than 0.2 mm.

The thickness of the artificial microstructures is from 0.005 to 0.05 mm.

The thickness of the artificial microstructures is 0.018 mm.

The thickness of the material sheet layer is smaller than or equal to 1/10 of the wavelength of the electromagnetic wave to be responded by the artificial electromagnetic material.

The first substrate and the second substrate are virtually divided into a plurality of rectangular substrate unit pairs in array arrangement, and an artificial structure is attached in the middle of each substrate unit pair.

The length, the width and the thickness of the substrate units in each substrate unit pair are respectively smaller than or equal to 1/10 of the wavelength of the electromagnetic wave to be responded by the artificial electromagnetic material.

The total length and the total width of the artificial microstructures are respectively not smaller than 1/2 of the length and width of the substrate units in each substrate unit pair.

The artificial microstructures are metal filaments arranged into geometric patterns.

The artificial microstructures are I-shaped or flat snowflake-shaped.

The artificial microstructures are flat snowflake-shaped derived structures.

The artificial microstructures are corresponding to the wavelength of the electromagnetic wave to be responded by the artificial electromagnetic material, and the wave impedance Z of the artificial electromagnetic material meets the condition: $0.8 \leq Z \leq 1.2$.

The artificial microstructures comprise two I-shaped structures which are orthogonal to each other.

The artificial microstructures also comprise at least one line segment connected to the middle connecting line of the I-shaped structures.

The line segments connected to the middle connecting line of the I-shaped structures appear in pairs, and are symmetric with respect to the middle point of the middle connecting line.

The artificial microstructures comprise two I-shaped metal wires which are in different dimensions and are non-intersecting.

The two I-shaped metal wires are arranged side by side, and the directions of the middle vertical lines in the I shapes are in the same line.

The first substrate and the second substrate are virtually divided into a plurality of rectangular substrate unit pairs in array arrangement, an artificial structure is attached in the middle of each substrate unit pair, the frequency of the electromagnetic wave to be responded by the artificial electromagnetic material is 7.5 GHz, and the dimension of each substrate unit in the rectangular substrate unit pairs is 4 mm×4 mm×4 mm.

The dimensions of the two I-shaped metal wires are 1.5 mm×1.5 mm and 2 mm×2 mm respectively, and the wire width is 0.1 mm.

The artificial electromagnetic material implementing the present invention achieves the beneficial effects that the first substrate and the second substrate on both sides of the artificial microstructure are in such tight contact therewith that the number of electric field lines passing through the substrates is increased and the equivalent permittivity of the metamaterial is effectively improved.

BRIEF DESCRIPTION OF DRAWINGS

To illustrate the technical solutions in the embodiments of the present invention or in the prior art more clearly, the following briefly introduces the accompanying drawings required for describing the embodiments or the prior art. Apparently, the accompanying drawings in the following description show merely some embodiments of the present invention, and a person of ordinary skill in the art may still derive other drawings from these accompanying drawings without creative efforts.

DETAILED DESCRIPTION OF THE INVENTION

Figure 1:
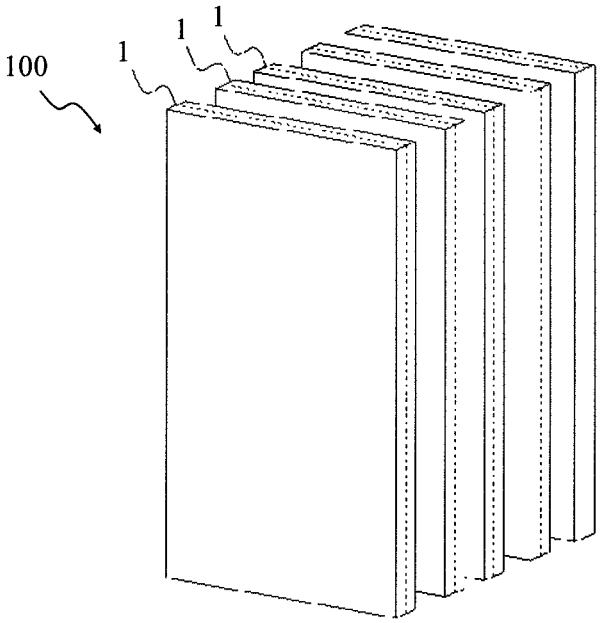
FIG. 1 is a schematic diagram of an artificial electromagnetic material according to the first embodiment of the present invention.
Figure 2:
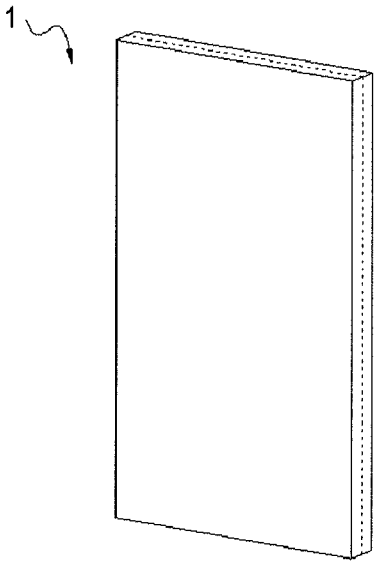
FIG. 2 is a schematic diagram of the material sheet layer of an artificial electromagnetic material illustrated in FIG. 1.

Referring to FIG. 1 and FIG. 2, the present invention relates to an artificial electromagnetic material 100, comprising at least one material sheet layer 1 as illustrated in FIG. 1. When a plurality of material sheet layers 1 are employed, the material sheet layers are superposed along a direction vertical to the sheet layers and are assembled integrally in a mechanical connection, welding or adhesion manner. The surfaces of the two adjacent material sheet layers of the integrally assembled artificial electromagnetic material may be arranged in a contact manner, and may also be arranged with certain spaces. The space may be smaller than the thickness of one material sheet layer, and may also be several times or several tens of times larger than the thickness of one material sheet layer.

Figure 3:
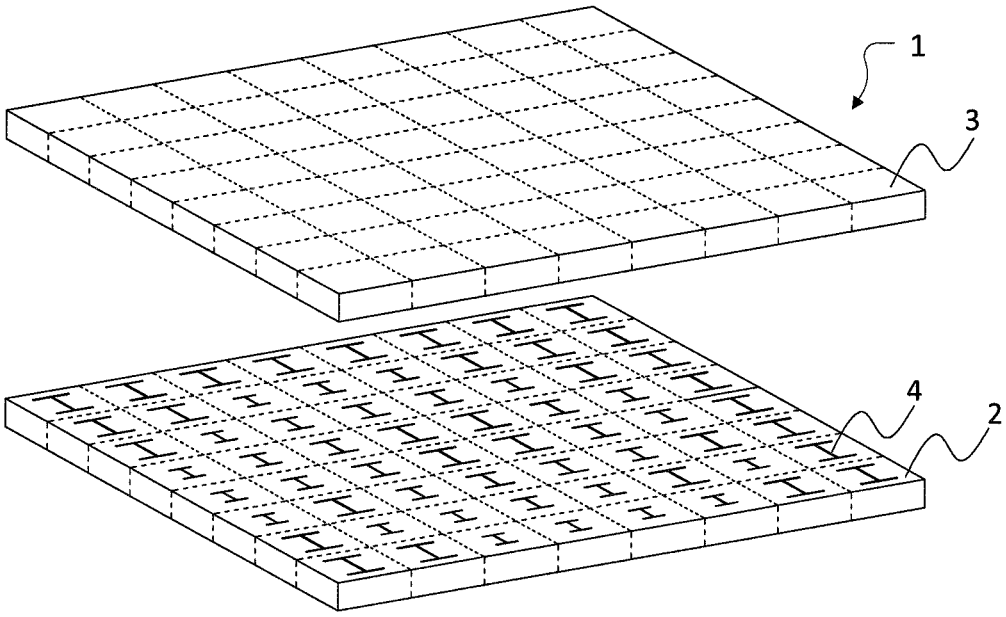
FIG. 3 is a schematic decomposition diagram of a material sheet layer illustrated in FIG. 2.

Referring to FIG. 2 and FIG. 3, each material sheet layer 1 comprises two identical sheet-like substrates with uniform and equal thickness, which are respectively the first substrate 2 and the second substrate 3. The substrate may be made of ceramic materials with high permittivity such as FR-4, F4b, CEM1, CEM3 or TP-1. The substrate may also be made of polytetrafluoroethylene, ferroelectric materials, ferrite materials or ferromagnetic materials.

The two substrates are oppositely superposed, and a plurality of artificial microstructures 4 in array arrangement are attached on the surface, facing the second substrate 3, of the first substrate 2. In the present invention, the surfaces of the substrates particularly refer to two planes with the maximum area parallel with each other in external contours of the substrates, and the direction vertical to the planes are defined as the thickness directions of the substrates and the whole artificial electromagnetic material 100. In this case, the length of the substrate in the thickness direction is the thickness of the substrate, and a circle of planes connected in sequence parallel with the thickness direction are side edges of the substrates.

A substance capable of connecting the substrates such as liquid substrate material is filled between the two substrates of each material sheet layer, and the two existing substrates are adhered by the substance after being cured, forming an independent and integral body, or the two substrates are pressed together in a manner such as hot press molding. Therefore, the space between the two substrates should be not more than the thickness of the artificial microstructures, or substantially equal to the thickness of the artificial microstructures.

The two substrates are respectively virtually divided into a plurality of cubical grids which are completely the same by using a group of a plurality of first planes with equal spaces which are parallel with each other and another group of a plurality of second planes with equal spaces which are parallel with each other, wherein the first planes and the second planes are vertical to each other and vertical to the surfaces of the substrates at the same time.

Figure 4:
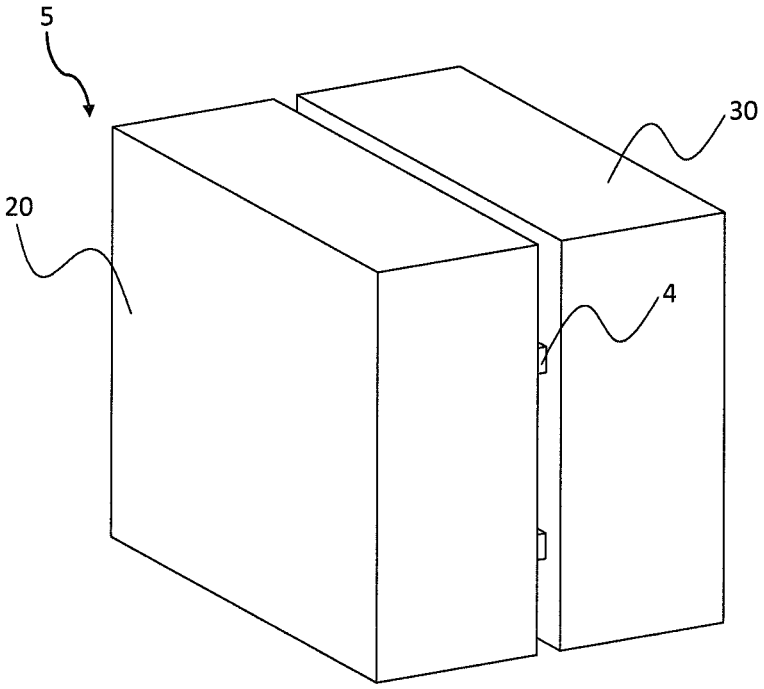
FIG. 4 is a schematic diagram of the material unit of a sheet layer illustrated in FIG. 2.

Each grid of the first substrate 2 is a first substrate unit 20, and each grid of the second substrate 3 is a second substrate unit 30, and an artificial microstructure 4 is attached on one surface of each first substrate unit 20. In this way, each first substrate unit 20 and each second substrate unit 30 which are opposite, as well as the artificial microstructure 4 on the first substrate unit 20, form a material unit together as illustrated in FIG. 4. The whole material sheet layer 1 can be regarded as an array consisting of a plurality of material units 5 with respect to one direction as a row and the other direction vertical to the direction as a line.

The artificial electromagnetic material is applied in a specific electromagnetic field environment, and the wavelength of the electromagnetic wave in the electromagnetic field environment is known or predetermined. In the present invention, preferably, the length, width and thickness of each cubical material unit 5 is not more than 1/10 of the wavelength of the electromagnetic wave. Assuredly, the length, width and thickness of each cubical material unit are respectively not more than ½ of the wavelength of the electromagnetic wave.

Figure 5:
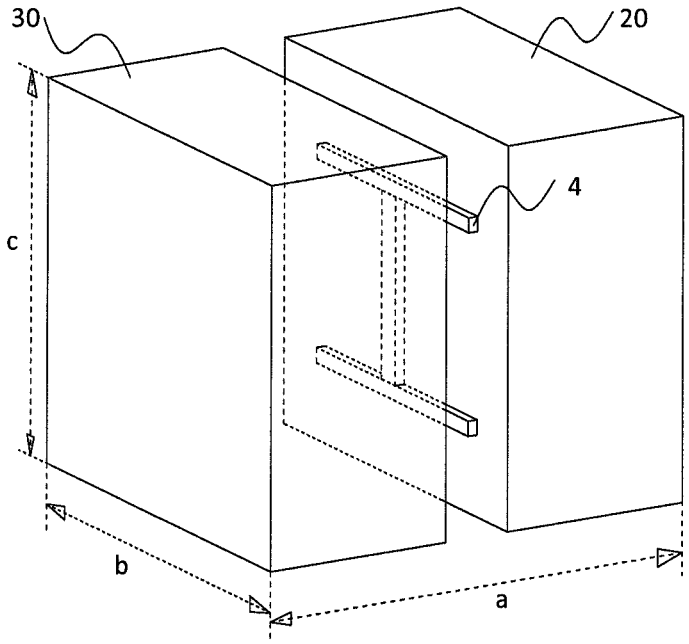
FIG. 5 is a decomposition schematic diagram of a material unit illustrated in FIG. 4.

The specific structure of the material unit 5 is illustrated in FIG. 5, and comprises the first substrate unit 20, the artificial microstructure 4 on the first substrate unit 20 and the second substrate unit 30. The artificial microstructure 4 is a metal filament arranged into certain geometric shapes or topological shapes, and the material of the metal filament is usually selected from nonferrous metals with good electric conductivity such as silver and copper. The artificial microstructure 4 according to the embodiment is an I-shaped metal filament, and comprises a linear first metal filament and two second metal filaments vertically connected to both ends of the first metal filament respectively.

The artificial microstructure 4 may also be in other shapes, such as in a planar two-dimensional snowflake shape, and comprises two cross-shaped first metal filaments which are mutually crossed vertically and four second metal filaments which are respectively connected to both ends of each first metal filament respectively. The artificial microstructure 4 may also be a flat snowflake-shaped derived structure, namely besides the artificial microstructure comprises two first metal filaments and four second metal filaments in a planar snowflake shape, the artificial microstructure also comprises third metal filaments vertically connected to both ends of each second metal filament respectively, fourth metal filaments vertically connected to both ends of each third metal filament respectively, and so on.

Assuredly, the artificial microstructure 4 in the present invention may also be realized in various manners. Any structure composed of metal filaments or metal wires, which is provided with certain geometric figures and capable of responding to the electromagnetic field, may serve as the artificial microstructure 4 in the present invention.

The artificial microstructure 4 is attached on the surface of the first substrate, and the metal filaments forming the artificial microstructures 4 have certain thickness. Therefore, he thickness of the material unit 5 (i.e., the thickness of the material sheet layer 1) is equal to the sum of the thickness of the first substrate 2, the thickness of the second substrate 3 and an space between the first substrate 2 and the second substrate 3, and the space between the first substrate 2 and the second substrate 3 is equal to the sum of the thickness of the artificial microstructure 4 and the space from the outer surface of the artificial microstructure 4 to the surface of the second substrate 3 opposite to the outer surface of the artificial microstructure.

Preferably, the first substrate and the second substrate 3 in the present invention are clamped, so that the artificial microstructure 4 is directly attached on the surface of the second substrate 3, and the space between the first substrate and the second substrate is equal to the thickness of the artificial microstructure 4.

However, the artificial microstructure 4 is thin, certain errors exist during manufacturing, processing and assembling processes, the artificial microstructure 4 cannot be attached on the second substrate 3 directly to form a gap, and the gap is allowed within a certain range.

Therefore, in the present invention, the outer surface of the artificial microstructure 4 is basically attached on the second substrate 3, i.e., the space between the first substrate and the second substrate is basically equal to the thickness of the artificial microstructure 4. The term "substantially equal" herein refers to that the space d is substantially equal to the thickness s of the artificial microstructure, and the term "equivalent" in common sense refers to the space and the thickness are in the same order of magnitude, i.e., $s \leq d \leq 10s$, which is further defined as $s \leq d \leq 2s$, and preferably defined as d=s in the present invention.

Usually, the thickness s of the artificial microstructure 4 of the artificial electromagnetic material is from 0.005 mm to 0.05 mm, and is 0.018 mm preferably in the present invention; and the space between the first substrate and the second substrate is within the range of 0.005-0.5 mm, and is smaller than 0.2 mm preferably.

The known artificial electromagnetic material is a novel artificial synthetic material capable of specially responding to electromagnetism, the existing artificial electromagnetic material is formed by superposing a plurality of same substrates, each substrate is provided with an artificial microstructure 4, and a gap between the adjacent substrate, relative to the thickness of the artificial microstructure 4, is relatively thick (usually not in the same order of magnitude). Therefore, the action range of each artificial microstructure 4 is only limited to the attached substrate.

In the present invention, the first substrate 2 and the second substrate 3 are clamped, so that both the first substrate and the second substrate are contacted or basically contacted with the artificial microstructure 4, and the artificial microstructure 4 can simultaneously act on the first substrate 2 and the second substrate 3 while the artificial microstructure responds on the electromagnetic wave.

For example, in the embodiment as illustrated in FIG. 5, the artificial microstructure 4 is I-shaped, which can be equivalent to series connection with a capacitor and an inductor, and the capacitor has an edge effect to form an electric field; both sides of the artificial microstructure 4 are provided with substrates; a part of electric field lines can penetrate through the substrates, and the electric field lines passing through the substrates can respond to electrons inside the substrates, so that the substrates are resonated, and the equivalent permittivity of the whole material unit 5 is changed. The equivalent permittivity of the material unit 5 is directly proportional to the product of the filed lines passing through the substrates and the permittivity of the substrates, namely the more the passing-through electric field lines, the larger the permittivity of the substrates is, and the larger the equivalent permittivity is.

When the artificial microstructure on the existing artificial electromagnetic material responds to the electromagnetic wave, the field lines only on one side of the artificial microstructure penetrate through the attached substrates, and the other side of the artificial microstructure is idle because of not being contacted with the substrate on the other side; in the present invention, the field lines on both sides of the artificial microstructure 4 respectively penetrate through the first substrate 2 and the second substrate 3, so that the number of the passing electric field lines is increased; and therefore, the permittivity of the material unit 5 is improved, and the permittivity of the whole artificial electromagnetic material is finally improved.

Figure 6:
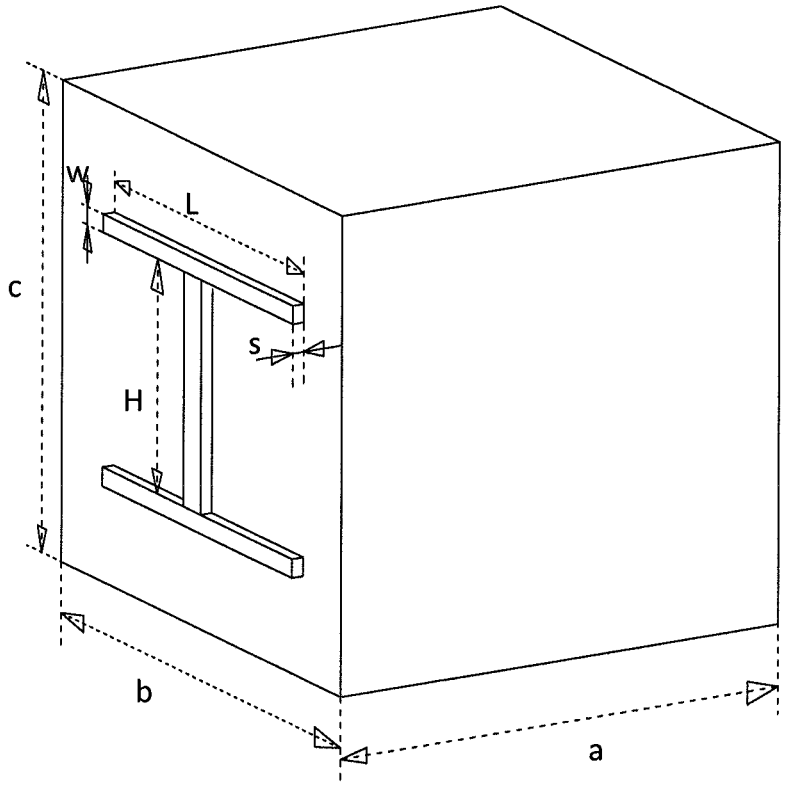
FIG. 6 is a schematic diagram of a material unit in the prior art.

For example, in a contrast embodiment, as illustrated in FIG. 5 and FIG. 6, the substrates in the prior and in the present invention are all made of FR-4 material with a permittivity of 4.8, the artificial microstructure 4 is selectively made of nonferrous metals with good electric conductivity such as copper or silver, the thickness a of the material sheet layer 1 is 1 mm, and the length b and width c of each material unit 5 is 1 mm; and the artificial microstructure 4 is I-shaped, the thickness s is 0.018 mm, the wire width w of the metal wires is 0.1 mm, the length H of the vertical first metal filament is equal to 0.8 mm, and the length of the two parallel second metal filaments is equal to 0.8 mm. The measurement frequency point of the selected electromagnetic wave is from 2.4 GHz to 2.6 GHz.

In the present invention as illustrated in FIG. 5, the thickness of the first substrate and the second substrate is 0.49 mm, and the space d between the first substrate and the second substrate is 0.02 mm. The measured permittivity of the material unit 5 is from 30 to 35.

In the prior art as illustrated in FIG. 6, the thickness of the substrates is 0.982 mm, and the measured permittivity of the material unit is from 4 to 10.

Therefore, the permittivity of the material unit 5 provided with two substrates in the present invention is extremely higher than that of a material unit of a single substrate in the prior art; and compared with the artificial electromagnetic material in the prior art, extremely large advantages are represented.

Moreover, if substrates with high permittivity are adopted, for example, if ceramics is selected as the substrates, the permittivity may even reach about 80 which is an unreachable value of materials in the nature and the existing artificial electromagnetic material, thereby meeting some special requirements on special occasions.

Figure 7:
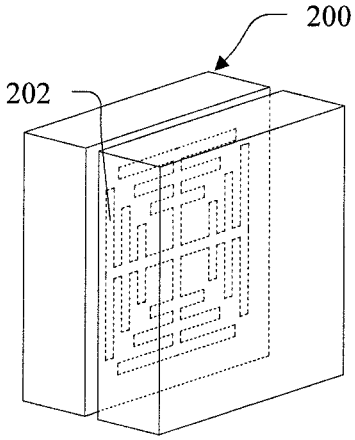
FIG. 7 is a schematic diagram of a material unit according to the second embodiment of the present invention.

Referring to FIG. 7, the difference between the artificial electromagnetic material 200 according to the second embodiment of the present invention and the artificial electromagnetic material according to the first embodiment of the present invention is that the artificial microstructure according to the embodiment can be a snowflake-shaped derived structure, of course, the artificial microstructure may also be a snowflake-shaped structure, i.e., a structure which is composed of two vertically orthogonal I-shaped structure and formed by vertically and averagely dividing the middle connecting line of the two I-shaped structures mutually. With the snowflake-shaped structure and a derived structure thereof are employed, the artificial microstructure has isotropic characteristics, and accommodates the isotropic characteristic requirement on the wave impedance of air to the electromagnetic wave.

Furthermore, designing specific dimensions enables the wave impedance Z of the artificial electromagnetic material having the artificial microstructures for the electromagnetic wave with specific frequency or frequency band to be 1 or approach 1, thereby achieving the impedance matching. Herein, with respect to approaching 1, a definition is given as follows: $0.8 \leq Z \leq 1.2$. The wave impedance is equal to 1, which is the same as that of the electromagnetic wave of air to the electromagnetic wave, so that, when the electromagnetic wave is incident to the artificial electromagnetic material, namely, equivalently incident to air, the interface inflection is little, the electromagnetic wave completely penetrates through the material, is little in consumption, and may be used in wave-transmitting materials.

Figure 8:
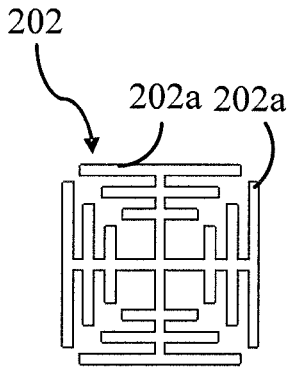
FIG. 8 is a schematic diagram of an artificial microstructure illustrated in FIG. 7.

The snowflake-shaped derived structure is illustrated in FIG. 7 and FIG. 8, the artificial microstructure 202 comprises I-shaped structures 202*a* which are orthogonal to each other, and a plurality of line segments symmetric with respect to the middle connecting line are further connected on the middle connecting line of the I-shaped structures.

Figure 9:
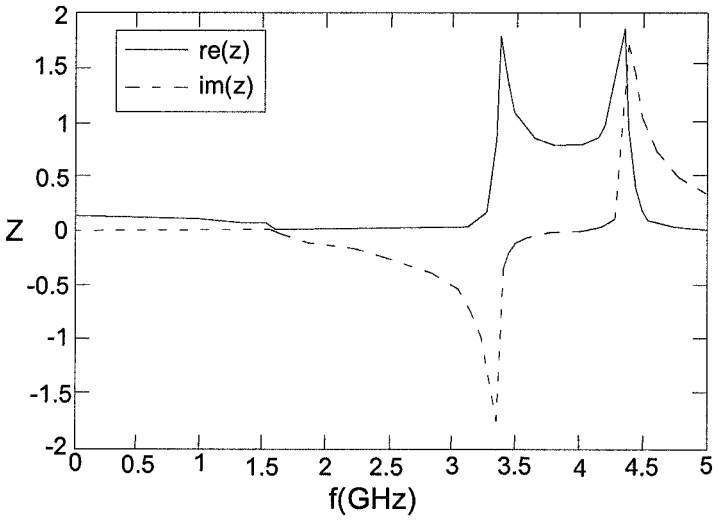
FIG. 9 is a simulation diagram of a magnetic wave by adopting the artificial electromagnetic material of the material unit illustrated in FIG. 7.

The electromagnetic wave is illustrated in FIG. 9 through the simulation diagram of the artificial electromagnetic material 200; through solid lines in the FIG. 9, the wave impedance, relative to the incident electromagnetic wave with the frequency of 3.5 GHz to 4.3 GHz, of the artificial electromagnetic material 200, approaches 1, thus the impedance matching of air can be effectively achieved; and through dotted lines in the diagram, the consumption of the incident electromagnetic wave inside the frequency band is relatively low. Therefore, the artificial electromagnetic material 200 according to the embodiment can reduce the reflection of the incident electromagnetic wave, and the energy consumption is reduced.

When the matching of air needs to be performed at other frequency bands, dimension reduction and backward shift of matched frequency band as well as dimension increase and forward shift of matched frequency band can be achieved by changing the dimension of the material units or the dimensions of the microstructures.

Figure 10:
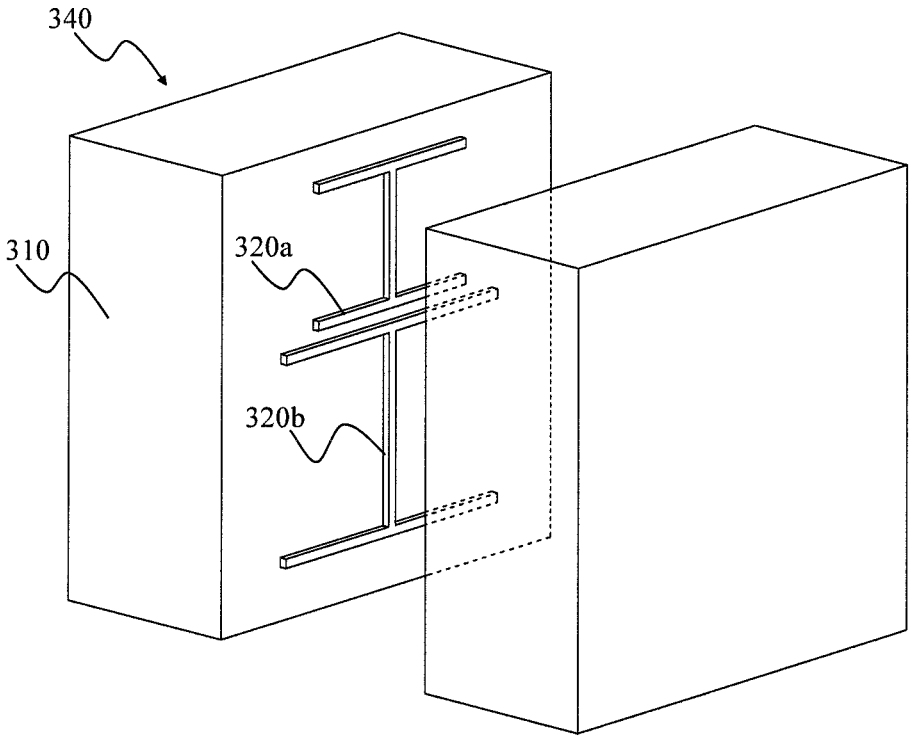
FIG. 10 is a schematic diagram of a material unit according to the third embodiment of the present invention.

Referring to FIG. 10, the difference between the artificial electromagnetic material according to the third embodiment of the present invention and the artificial electromagnetic material according to the first embodiment of the present invention is that the artificial microstructure 320 comprises two I-shaped metal wires 320*a* and 320*b* which are different in dimensions and non-intersecting. To enable the two I-shaped metal wires 320*a* and 320*b* to have an identical or similar electromagnetic field response to the electromagnetic field, the responding effects are superposed, but not counteracted. Therefore, preferably, the two I-shaped metal wires 320*a* and 320*b* of each artificial microstructure 320 are arranged side by side. To be specific, two pairs of parallel lines of the two I-shaped metal wires are parallel with each other, and two middle vertical lines are parallel with each other.

In the present invention, the directions of the middle vertical lines of the two I-shaped metal wires 320*a* and 320*b* are preferably in the same line, such that the two I-shaped metal wires are arranged up and down.

The refractivity of each material unit 340 is related to the surface occupied by the artificial microstructure 320 relative to the surface of the first substrate unit 310. Therefore, the total length and the total width of the artificial microstructures 320 should be as large as possible, preferably not less than ½ of the length and the width of the first substrate unit 310 respectively. The total length of the artificial microstructures 320 is the space between an upmost parallel line and a downmost parallel line; and the total width of the artificial microstructures is the length of the longest parallel line in four parallel lines of the two I-shaped metal wires 320*a* and 320*b*.

For example, when the artificial electromagnetic material according to the present invention is to be applied in a working environment of 7.5 GHz electromagnetic waves, the dimension of each cubical substrate unit is designed to 4 mm×4 mm×4 mm, the dimensions of the two I-shaped metal wires 320*a* and 320*b* are designed to 1.5 mm×1.5 mm and 2 mm×2 mm respectively, the wire width is designed to 0.1 mm, the total length of the artificial microstructures is designed to 3.8 mm, and the total width of the artificial microstructures is designed to 2 mm.

Based on the stimulation of the artificial microstructures by using the CST stimulation software, within a range of 2-15 GHz, for example, within a bandwidth of 13 GHz, the loss of the refractivity is little along with the increase of the frequency, thereby providing favorable conditions for achieving ultra-wideband effect. However, the band width of the existing artificial microstructure with only one I-shaped metal wire is difficult to achieve the above result.

According to the artificial microstructure according to this embodiment, the resonance frequency of the artificial electromagnetic material is high, the effective work frequency band becomes wide, and the application range is broadened.

Detailed above are only preferred embodiments of the present invention, but are not intended to limit the scope of the present invention. Equivalent modifications or variations made based on claims of the present invention shall fall into the scope of the present invention.

What is claimed is:

1. An artificial electromagnetic material, comprising:

at least one material sheet layer, each material sheet layer being provided with a first substrate and a second substrate which are oppositely arranged; and a plurality of artificial microstructures being attached on a surface of the first substrate, wherein the surface of the first substrate is faced with the second substrate, wherein the total length and the total width of the plurality of artificial microstructures are respectively not less than ½ of the length and the width of substrate units in each rectangular substrate unit pair, so that the artificial electromagnetic material have preferable refractivity, wherein a space d between the first substrate and the second substrate and a thickness s of the artificial microstructure meets the conditions: $s \leq d \leq 2s$, and wherein the artificial microstructures comprise two I-shaped structures which are different in dimensions and non-intersecting.

2. The artificial electromagnetic material according to claim 1, wherein the two I-shaped metal wires are arranged side by side, and the directions of the middle vertical lines in the I shapes are in the same line.

3. The artificial electromagnetic material according to claim 2, wherein the first substrate and the second substrate are virtually divided into a plurality of rectangular substrate unit pairs in array arrangement, an artificial structure is attached in the middle of each substrate unit pair, the frequency of the electromagnetic wave to be responded by the artificial electromagnetic material is 7.5 GHz, and the dimension of each substrate unit in the rectangular substrate unit pairs is 4 mm×4 mm×4 mm.

4. The artificial electromagnetic material according to claim 3, wherein the dimensions of the two I-shaped metal wires are 1.5 mm×1.5 mm and 2 mm×2 mm respectively, and the wire width is 0.1 mm.

* * * * *